US009252540B2

(12) United States Patent
Schoenfeld et al.

(10) Patent No.: US 9,252,540 B2
(45) Date of Patent: Feb. 2, 2016

(54) ELECTRICAL PLUG CONNECTOR HAVING AN UPSTREAM CONTACT TERMINAL

(75) Inventors: Michael Schoenfeld, Leinfelden-Echterdingen (DE); Achim Puettner, Aalen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 182 days.

(21) Appl. No.: 13/995,698

(22) PCT Filed: Dec. 2, 2011

(86) PCT No.: PCT/EP2011/071635
§ 371 (c)(1),
(2), (4) Date: Sep. 16, 2013

(87) PCT Pub. No.: WO2012/084458
PCT Pub. Date: Jun. 28, 2012

(65) Prior Publication Data

US 2013/0344726 A1 Dec. 26, 2013

(30) Foreign Application Priority Data

Dec. 20, 2010 (DE) ..... 10 2010 063 486

(51) Int. Cl.

| | |
|---|---|
| ***H01R 9/24*** | (2006.01) |
| ***H01R 13/652*** | (2006.01) |
| ***H01R 13/11*** | (2006.01) |
| ***H01R 13/648*** | (2006.01) |
| *H01R 43/16* | (2006.01) |

(52) U.S. Cl.
CPC ..... *H01R 13/652* (2013.01); *H01R 13/114* (2013.01); *H01R 13/6485* (2013.01); *H01R 43/16* (2013.01)

(58) Field of Classification Search
CPC . H01R 13/652; H01R 13/6485; H01R 13/114
USPC ..... 439/103, 843, 851, 891, 924.1
See application file for complete search history.

(56) References Cited

U.S. PATENT DOCUMENTS

| | | | | |
|---|---|---|---|---|
| 5,622,523 | A | 4/1997 | Kan et al. | |
| 8,342,891 | B2 * | 1/2013 | Fukushi | 439/752 |
| 8,708,719 | B2 * | 4/2014 | Iihoshi | 439/140 |
| 2014/0087607 | A1 * | 3/2014 | Kojima et al. | 439/891 |

FOREIGN PATENT DOCUMENTS

| | | |
|---|---|---|
| DE | 100 40 893 | 8/2001 |
| EP | 1 229 609 | 8/2002 |
| GB | 2 359 940 | 9/2001 |
| WO | WO 96/38885 | 12/1996 |

OTHER PUBLICATIONS

International Search Report, PCT International Application No. PCT/EP2011/071635, dated Feb. 16, 2012.

* cited by examiner

*Primary Examiner* — Khiem Nguyen
(74) *Attorney, Agent, or Firm* — Kenyon & Kenyon LLP

(57) ABSTRACT

In an electrical plug connector having multiple metal contacts situated in parallel to each other for electrically contacting metal contact pins of a mating plug, a separate contact terminal is situated upstream from at least one of the contacts according to the invention, which electrically conductively contacts the at least one contact and is designed for being penetrated by a contact pin.

5 Claims, 2 Drawing Sheets

ELECTRICAL PLUG CONNECTOR HAVING AN UPSTREAM CONTACT TERMINAL

FIELD

The present invention is directed to an electrical plug connector.

BACKGROUND INFORMATION

In addition to sensors and actuators, control units are also contacted with the aid of electrical plug connections. Almost all control units are sensitive to overvoltages or unfavorable contacting sequences since these may damage the electronic components therein. In order to remedy this, in some control units extended ground pins have been introduced in order to achieve early "grounding" during the plug-in process. However, these conventional extended ground pins have, among others, the following disadvantages:

- first contacting of the extended ground pins is not reliable over all tolerance positions. It works in many cases but, due to tolerances, not always, since the ground pins are not sufficiently long for this purpose.
- much longer pins, which are expensive and difficult to manufacture within the tolerance, are needed on male plugs of the control unit.
- the extended ground pins are fixedly defined regarding their position. In another control unit wiring, a novel interface having the extended ground pins is needed and is to be defined at another location.

SUMMARY

An object of the present invention is to provide an alternative specific embodiment for the early contacting of a contact pin of the mating plug.

According to an example embodiment of the present invention, an additional metal contact terminal is situated in the electrical plug connector upstream from the actual contact of the electrical plug connector as an early contact. The metal contact terminal is preferably plugged into an insertion opening in the plug connector housing, situated upstream from the contact of the electrical plug connector, and snapped in place therein. The important advantage of the present invention is that, due to the electrically conductive contact terminal to be mounted on the electrical plug connector (for example, cable harness plug connector), which electrically contacts the corresponding contact in the electrical plug connector, a reliable early precontacting or ground contacting is made possible using standard contacts of the electrical plug connector and standard pins of the mating plug (for example, control unit plug).

Depending on the desired position and number of precontacts, one or more additional contact terminals may be situated upstream from the particular desired contacts of the electrical plug connector, so that any type of electric wiring (pin configuration) is made possible. Furthermore, for different embodiments, the same electrical plug connectors and mating plugs may always continue to be used. Early contacting according to the present invention with the aid of the upstream contact terminal is accomplished without extended ground pins, leaves plug connectors and mating plugs of wiring variants unchanged, and is reliable in any tolerance position.

Further advantages and advantageous embodiments of the subject matter of the present invention are described below and shown in the figures.

BRIEF DESCRIPTION OF THE DRAWINGS

The present invention is explained in greater detail below with reference to the exemplary embodiment depicted in the figures as an example.

DETAILED DESCRIPTION OF EXAMPLE EMBODIMENTS

Figure 1:
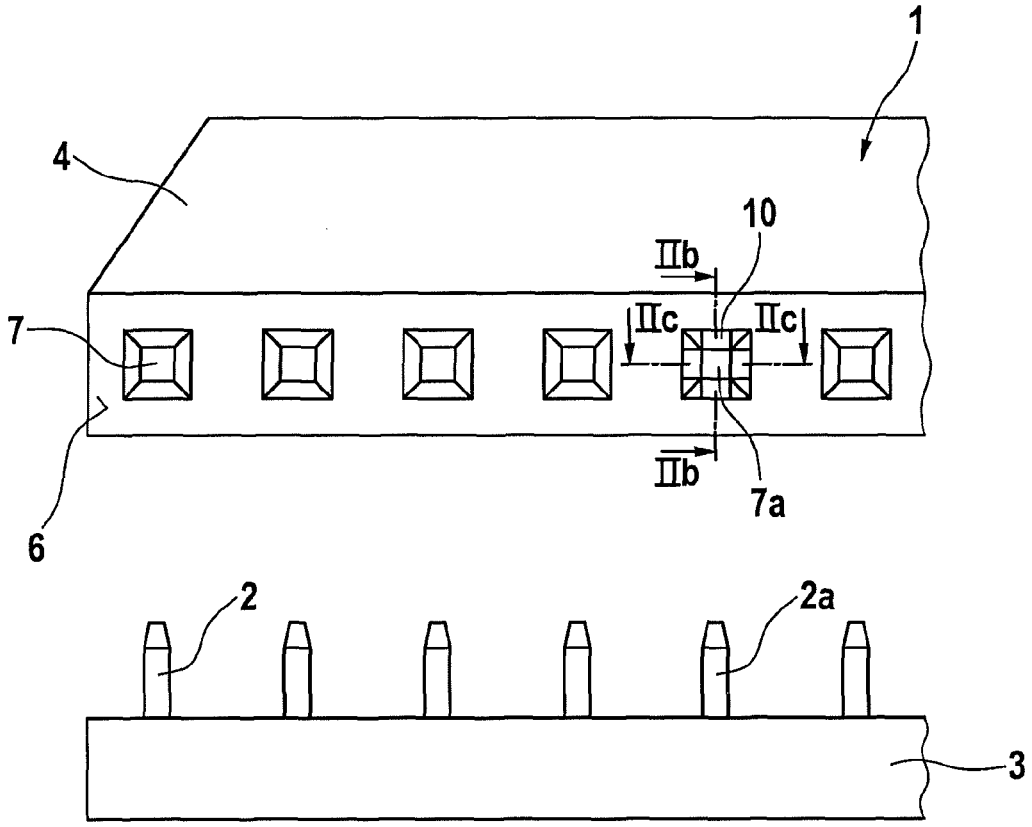
FIG. 1 schematically shows an example electrical plug connector according to the present invention having an additional contact terminal for early contacting of a mating plug.

Electrical plug connector 1 (for example, cable harness plug connector) shown in FIG. 1 is used for electrically contacting equally long and parallel metal contact pins 2 of a mating plug 3 (for example, control unit plug) which may be designed as a pin strip having contact pins 2 arranged in a row.

For each contact pin 2 of mating plug 3, plug connector 1 has metal contacts 5 in its plug connector housing 4, which are situated in parallel to each other (FIGS. 2*b*, 2*c*), and which may be designed, for example, as socket contacts. Housing front wall 6 of plug connector housing 4 has insertion openings 7 in the form of insertion funnels situated upstream from contacts 5, through which contact pins 2 of mating plug 3 may be inserted into plug connector housing 4 until contact with contacts 5.

In the exemplary embodiment shown, a separate metal contact terminal 10 is situated upstream from one of contacts 5, which is inserted in insertion opening 7*a* upstream from contact 5 and snapped or clipped in place therein. Clipped-in contact terminal 10 is in electrically conductive contact with the corresponding contact 5 and is designed to be penetrated by contact pin 2.

Figure 2A:
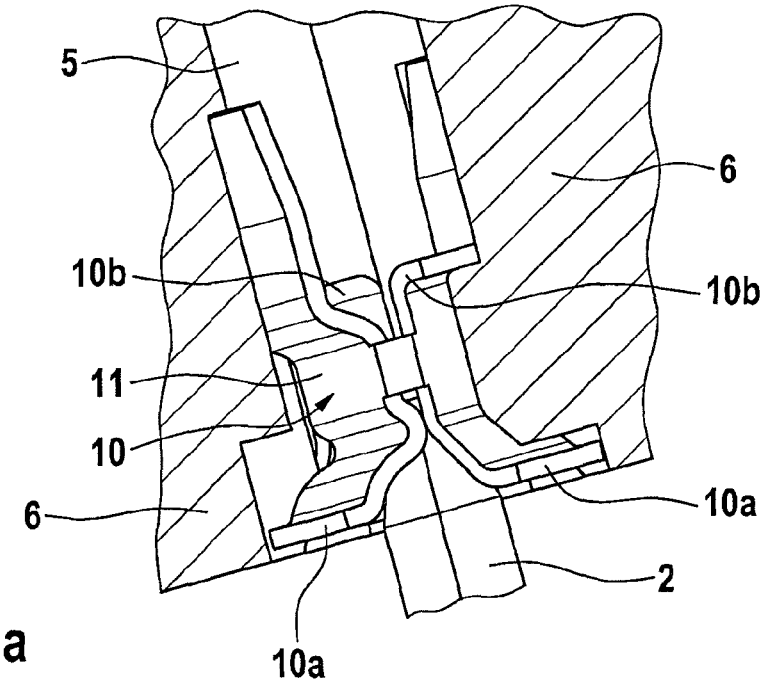
FIGS. 2*a* through 2*c* show detail views of the electrical plug connector shown in FIG. 1 in the area of an insertion opening provided with the additional contact terminal, namely in a sectioned perspective view (FIG. 2*a*) and in two sectional views (FIGS. 2*b*, 2*c*) along IIb-IIb and IIc-IIc.
Figure 2B:
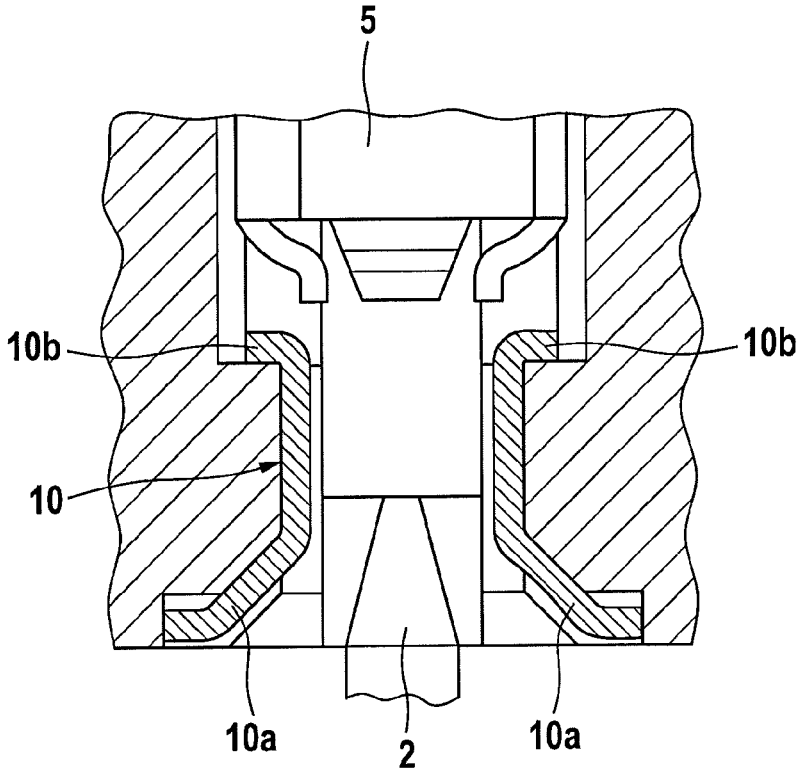
Figure 2C:
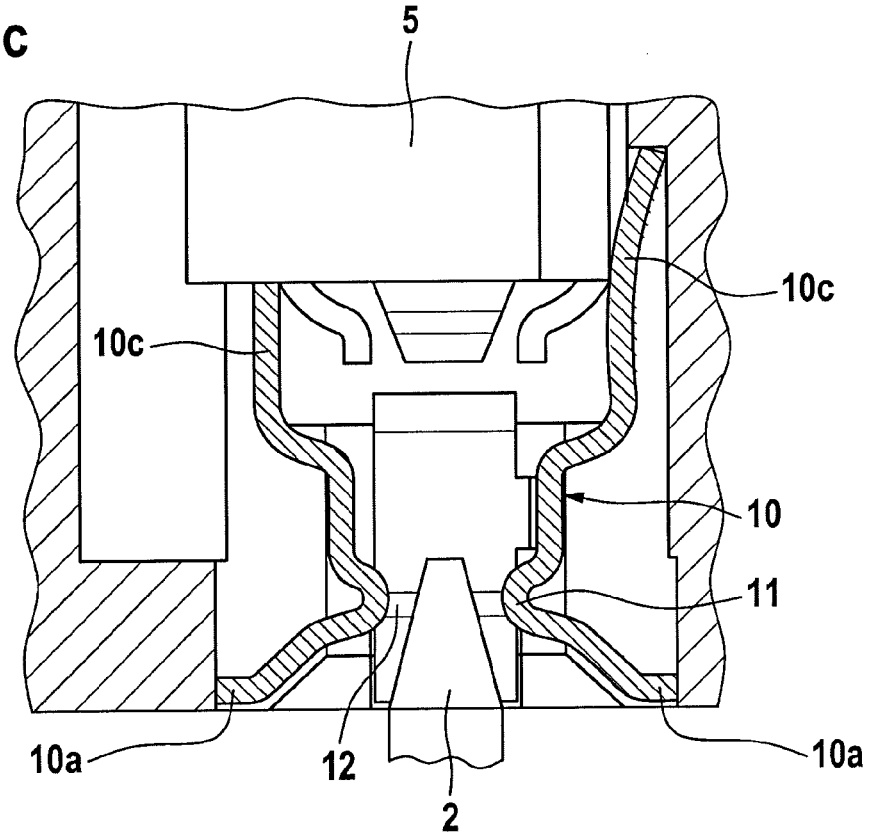

As shown in FIGS. 2*a* through 2*c*, contact terminal 10 has a quadrangular central section 11, which forms a quadrangular insertion opening 12 for contact pin 2 which has a quadrangular cross section. Next to the front side of central section 11, there are four rest arms 10*a* which are opposite each other in pairs with respect to insertion opening 12 and protrude outward, and on its rear side, there are two snap arms 10*b* which are opposite each other with respect to insertion opening 12 and are angled outward, as well as two contact arms 10*c* which are opposite each other with respect to insertion opening 12 and extend backward. Snap arms 10*b* and contact arms 10*c* are provided on different sides of insertion opening 12. Snap arms 10*b*, which are elastically deflected inward, and contact arms 10*c* of contact terminal 10 are inserted or clipped-in into insertion opening 7*a* to its snapped position, in which the front side of rest arms 10*a* and the rear side of snap arms 10*b* rest on housing front wall 6, and contact arms 10*c* rest, in an electrically conductive manner, on both sides of contact 5. Contact terminal 10 may be bent, for example, from a metal sheet as one piece.

If plug connector 1 and mating plug 3 are inserted into each other, the particular contact pin 2*a* of mating plug 3, which is inserted into insertion opening 7*a* provided with contact terminal 10, contacts its respective contact 5 via contact terminal 10 always reliably before all other contact pins 2, whose insertion openings 7 are not provided with a contact terminal. Contact pin 2*a* is thus contacted in plug connector 1 early compared to the other contact pins 2.

Depending on the desired position and number of pre-contacts, one or more additional contact terminals 10 may be situated upstream from the particular contacts 5 of plug connector 1, so that any type of electric wiring (pin configuration) is made possible. Furthermore, for different embodiments, the same electrical plug connectors 1 and mating plugs 3 may always be used.

What is claimed is:

1. An electrical plug connector having multiple metal contacts situated in parallel to each other for electrically contacting metal contact pins of a mating plug, and a separate contact terminal situated upstream from at least one of the contacts, which electrically conductively contacts the at least one of the contacts and is designed for being penetrated by one of the contact pins, wherein the electrical plug connector has a plug connector housing, and wherein the contact terminal is inserted into an insertion opening of the plug connector housing, situated upstream from the at least one of the contacts, and snapped into therein, and wherein a front side of at least one front rest arm and a back side of at least one snap arm of the contact terminal rest on a housing wall of the plug connector housing having insertion openings, and at least one contact arm extending backward rests on the respective electrical contact in an electrically conductive manner.

2. The electrical plug connector as recited in claim 1, wherein the contact terminal has at least two rest arms which are opposite each other with respect to the one of the contact pins, and at least two snap arms which are opposite each other with respect to the contact pin to penetrate, and at least two contact arms which are opposite each other with respect to the one of the contact pins.

3. An electrical plug connector having multiple metal contacts situated in parallel to each other for electrically contacting metal contact pins of a mating plug, and a separate contact terminal situated upstream from at least one of the contacts, which electrically conductively contacts the at least one of the contacts and is designed for being penetrated by one of the contact pins, and wherein the electrical plug connector further comprises an insertion opening, wherein the contact terminal is a metal contact terminal that:

is configured for clipping-in into the insertion opening for positioning of the contact terminal upstream from the at least one of the contacts; and includes at least one laterally protruding rest arm provided on a front side, at least one laterally protruding snap arm provided on a back side, and at least one contact arm extending backward.

4. The electrical plug connector as recited in claim 3, wherein the contact terminal has a central section which forms an opening for being penetrated by the one of the contact pins.

5. The electrical plug connector as recited in claim 3, wherein the contact terminal is bent from a metal sheet as one piece.

* * * * *